US008932077B2

(12) United States Patent
Li et al.

(10) Patent No.: US 8,932,077 B2
(45) Date of Patent: Jan. 13, 2015

(54) CARD EDGE CONNECTOR ASSEMBLY AND POSITIONING METHOD OF THE SAME

(71) Applicant: Hon Hai Precision Industry Co., Ltd., New Taipei (TW)

(72) Inventors: Hua Li, Kunshan (CN); Zhen-Hua Wang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 63 days.

(21) Appl. No.: 13/893,357

(22) Filed: May 14, 2013

(65) Prior Publication Data

US 2013/0309893 A1 Nov. 21, 2013

(30) Foreign Application Priority Data

May 15, 2012 (CN) ..... 2012 1 0149343
May 15, 2012 (CN) ..... 2012 2 0216885 U

(51) Int. Cl.
*H01R 13/60* (2006.01)

(52) U.S. Cl.
USPC ..... 439/540.1; 439/328

(58) Field of Classification Search
USPC ..... 439/328, 540.1
IPC ..... H01R 23/7005,23/7068, 13/6275, 13/518
See application file for complete search history.

(56) References Cited

U.S. PATENT DOCUMENTS

| | | | | |
|---|---|---|---|---|
| 5,882,211 | A * | 3/1999 | Choy et al. | 439/74 |
| 6,179,650 | B1 * | 1/2001 | Chih-Kai | 439/540.1 |
| 7,316,582 | B2 * | 1/2008 | Fan | 439/540.1 |
| 8,388,362 | B2 * | 3/2013 | Su | 439/153 |

* cited by examiner

*Primary Examiner* — Hien Vu
(74) *Attorney, Agent, or Firm* — Wei Te Chung; Ming Chieh Chang

(57) ABSTRACT

A card edge connector assembly comprising a first card edge connector comprising a first insulative housing, a pair of first latching arms disposed on opposite ends of the first insulative housing and a plurality of first conductive terminals retained in the first insulative housing; a second card edge connector including a second insulative housing, a pair of second latching arms located on the opposite ends of the second insulative housing and a plurality of second conductive terminals retained in the second insulative housing. The first and second terminals define pin-shaped solder portions respectively, wherein the first and second insulative housings define protruding portions and recessed portions mutually engaged with each other when the first and second insulative housings are disposed in a head to head arrangement. It can shorten distance between the first and second card edge connectors, which is conducive to miniaturization of connector assembly.

8 Claims, 6 Drawing Sheets

CARD EDGE CONNECTOR ASSEMBLY AND POSITIONING METHOD OF THE SAME

BACKGROUND OF THE INVENTION

1. Field of the Invention

The present invention relates to a card edge connector assembly and positioning method of the same, and more particularly to a card edge connector assembly set in a head to head patter.

2. Description of the Related Art

U.S. Pat. No. 5,882,211 issued on Mar. 16, 1999 discloses a card edge connector assembly including a standard connector and a reverse connector. The standard connector includes a longitudinal insulative housing, a pair of latching arms extending forwardly from the opposite ends of the insulative housing and a plurality of conductive terminals fixed in the insulative housing for transmitting signals. A key is located in the insulative housing close to the right lathing arm to prevent the mistaken installed of electrical card. The structure of the reverse connector is similar to the structure of the standard connector and the key of the reverse connector is located in the insulative housing close to the left lathing arm. The standard connector and the reverse connector are set on a circuit board in a head-to-head arrangement, which can shorten the line trajectory connected with the corresponding terminals of the standard connector and the reverse connector.

Due to the opposite ends of the insulative housings of the standard connector and the reverse connector are generally extending rearwardly a distance in order to facilitate the packaging, which causes a certain distance between the standard connector and the reverse connector set by head to head and it is not conducive to the development trend of miniaturization of electrical connector.

Further, the standard connector and the reverse connector are respectively accurate positioning when they are installed to the circuit board, which increases difficulty of installing and is not conducive to simply the process. Furthermore, the circuit board is set up an excessive number of the positioning holes to position the connector is bound to affect the circuit arrangement of the circuit board, thereby increasing the manufacturing cost.

Therefore, an improved card edge connector assembly and its positioning method is desired to overcome the disadvantages of the related arts.

BRIEF SUMMARY OF THE INVENTION

An object of the present invention is to provide a lower profile card edge connector assembly and a simply positioning method of the card edge connector assembly.

In order to achieve above-mentioned object, a card edge connector assembly adapted to being mounted on a mother board, comprising a first card edge connector comprising a first insulative housing with a first central slot, a pair of first latching arms disposed on opposite ends of the first insulative housing and a plurality of first conductive terminals retained in the first insulative housing; a second card edge connector including a second insulative housing with a second central slot, a pair of second latching arms located on the opposite ends of the second insulative housing and a plurality of second conductive terminals retained in the second insulative housing. The first and second conductive terminals define pin-shaped solder portions respectively, wherein the first and second insulative housings define protruding portions and recessed portions mutually engaged with each other when the first and second insulative housings are disposed in a head to head arrangement and the first and second latching arms extend far away from each other. It can shorten distance between the first and second card edge connectors so as to reduce the occupied space of the assembly on the mother board, which is conducive to miniaturization of connector assembly.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
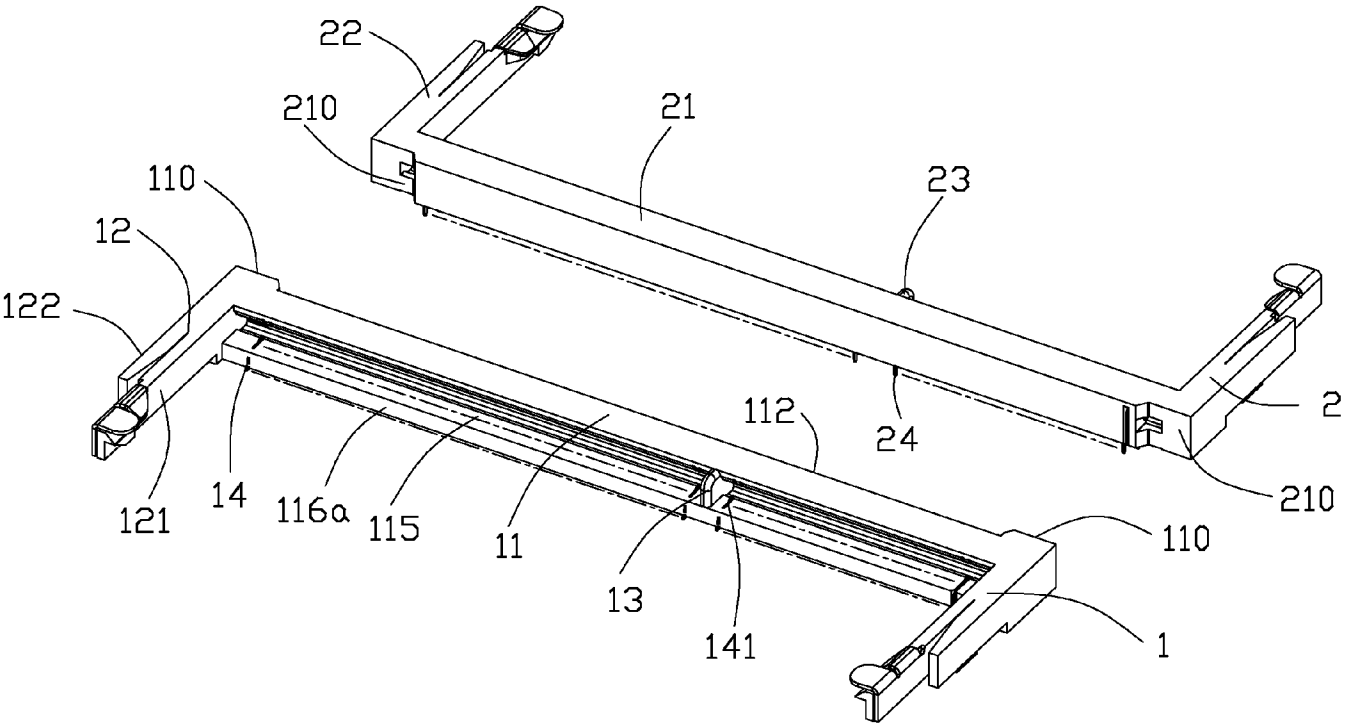
FIG. 1 is an exploded perspective view of a card edge connector assembly of a first embodiment in accordance with the present invention.

Reference will now be made to the drawing figures to describe a preferred embodiment of the present invention in detail. Referring to FIGS. 1 to 4, a card edge connector assembly mounted on a mother board 3 includes a first card edge connector 1 and a second card edge connector 2 for accommodating the electrical cards or daughter boards (not shown). In these shown embodiments shown in FIGS. 1 through 6, the first card edge connector is a standard DDR SODIMM connector used in a laptop equipment or the like, and the second card edge connector is a reverse DDR SODIMM connector in the laptop equipment or the like. The first card edge connector 1 and the second card edge connector 2 can be other types. For easily understanding, where the central slots opening are defined as a front side of the housing.

The first card edge connector 1 comprises an insulative housing 11 extending along a longitudinal direction, a pair of latching arms 12 located on the opposite ends of the insulative housing 11 and extending in a front-rear direction and a plurality of conductive terminals 14 loaded in the insulative housing 11. The insulative housing 11 made from insulating materials such as plastic, defines a central slot 115 opening forwards through a front side 116*a* in the front-rear direction and extending along the longitudinal direction thereof for receiving a front edge of the electrical card, and a key 13 located in the central slot 115 which is close to the right latching arm 12 to prevent a mis-mating of the electrical card. The conductive terminals 14 are divided into two rows to be accommodated in the upper and lower sides of the central slot 115 respectively for contacting with electrical cards. The terminals 14 include elastic connecting portion 141 in the central slot 115 and through-hole type soldering portion 142 extending vertically and downwards. The soldering portions 142 are hide behind the housing 11 and do not extending beyond a rear side 116*b* of the housing to reduce accuppied space of soldering portions on the mother board 3, especially the terminals of the lower row. The soldering portions 142 of the lower row are disposed near to a rear side 116*b* of the housing. The solder portions of the terminals can also be other structures, such as a solder ball structure alternatively. The latching arms 12 perpendicularly extend forwards far away from the front side of the housing, thereby defining a card-receiving space. The latching arms integrally extend from the insulating housing or made from a metallic material and attached to the housing. Each latching arms 12 defines a locking portion 121 and a stopping portion 122 located on an outsider of the locking portion 121. The locking portions 121 clasp the inserted card and the stopping portions 122 prevent an excessive outward movement of the locking portions 121. A pair of protruding portions 110 extends rearwardly from the opposite ends of the rear side 116*b* of the insulative housing, thereby defining a recess cavity 112 at the rear side 116*b*. A pair of positioning posts 111 projects downwardly from the protruding portions 110 during a mounting assembly of the first card edge connector 11 to the mother board.

The second card edge connector 2 is similar to the first card edge connector 1 in outline. The second connector 2 comprises an insulative housing 21 with a central slot 215 through a front side of the housing and a key, a pair of latching arm 22 perpendicularly extending forwards from the opposite ends of the insulative housing 22 and a plurality of conductive terminals 24 loaded in the insulative housing 21. Please note, the key 23 is close to the left latching arm 22, that means the connector is a reversed card edge connector. Through-hole type solding portions 242 extend downwards and do not beyond the rear side 226*b* of the housing. A pair of recessed portions 210 are disposed at opposite ends of the insulative housing 21 in the longitudinal direction, which are opposite to the latching arms 22.

Figure 2:
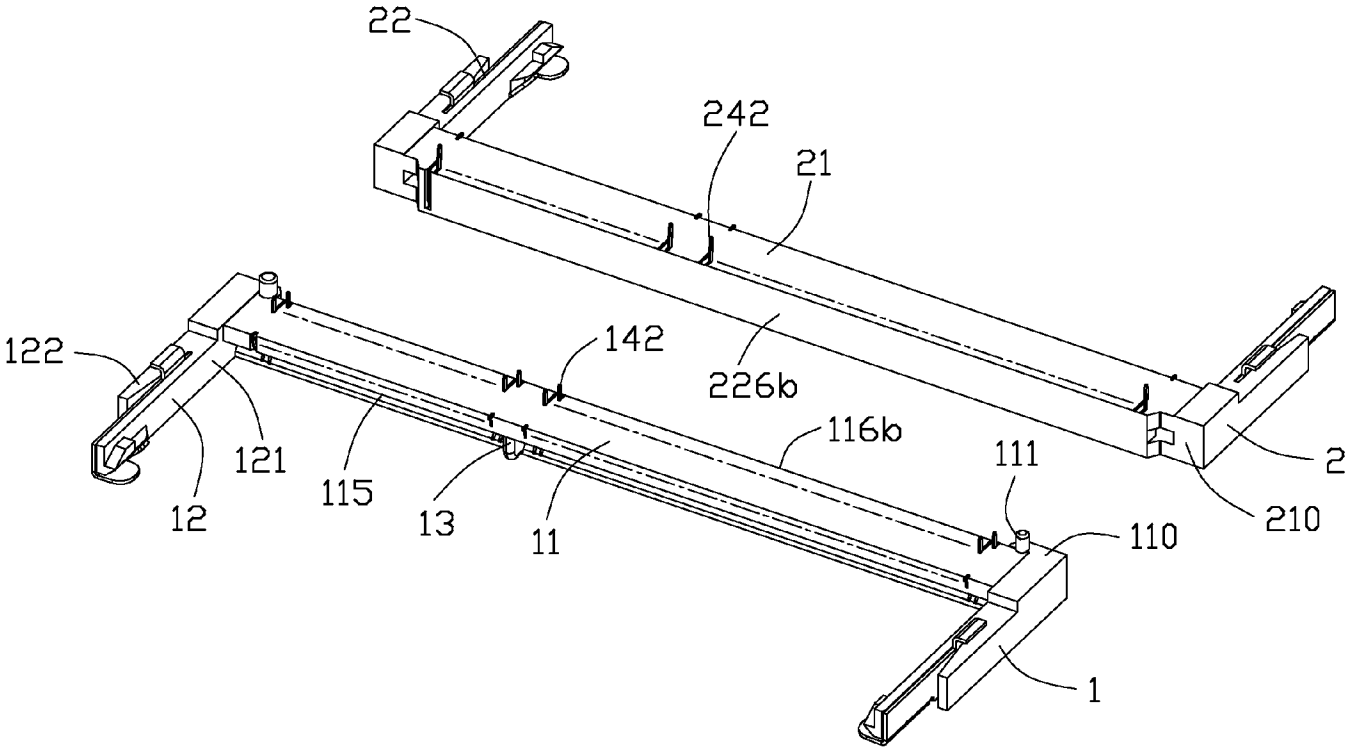
FIG. 2 is a perspective view of the card edge connector assembly shown in FIG. 1.
Figure 3:
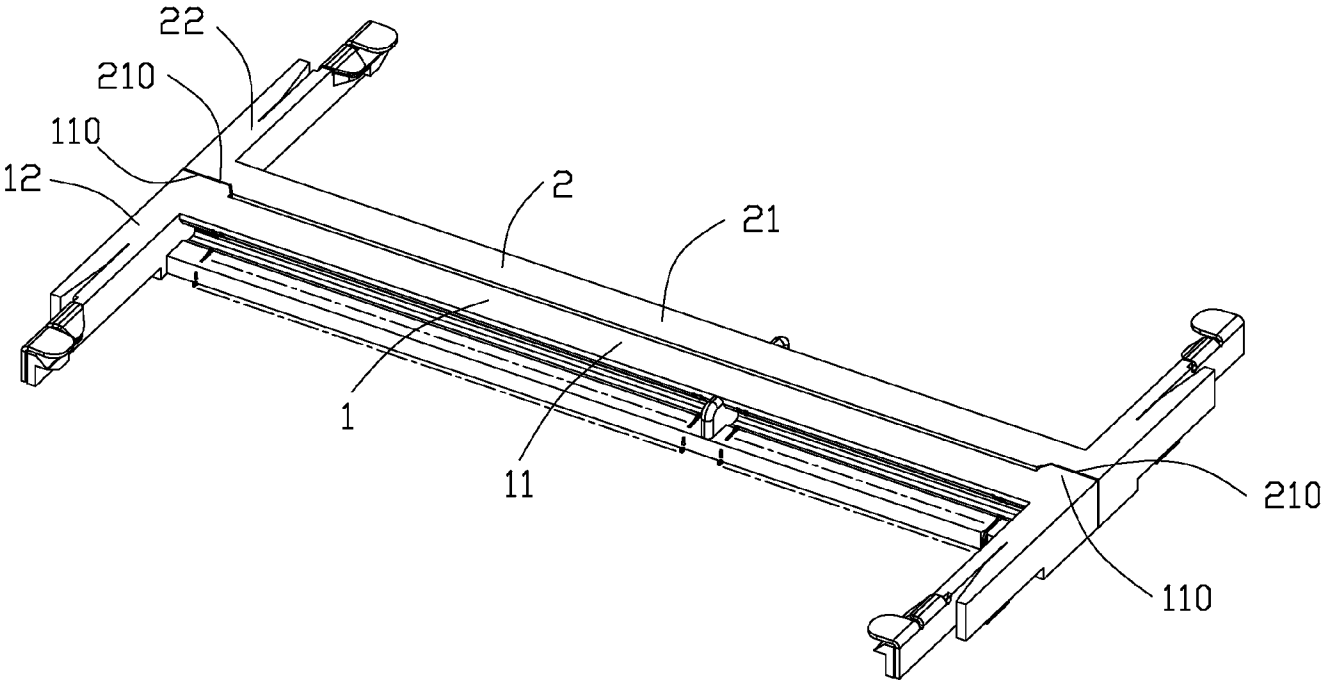
FIG. 3 is another exploded perspective view of the card edge connector assembly shown in FIG. 1.

The first and second connectors are assembled in a head to head arrangement. The rear sides 116*b*, 226*b* press against each other and the protruding portions 110 are received in the recessed portions 210. Please note FIG. 2, the recessed portions 210 opening through the rear side, lateral side and upper and lower sides, thus the insulative housing with recessed portions being easily manufactured. The soldering portions 242 are disposed behind the recessed portions in the front-rear direction. The protruding portions 110 disposed in front of soldering portions as best shown in FIG. 2.

Figure 4:
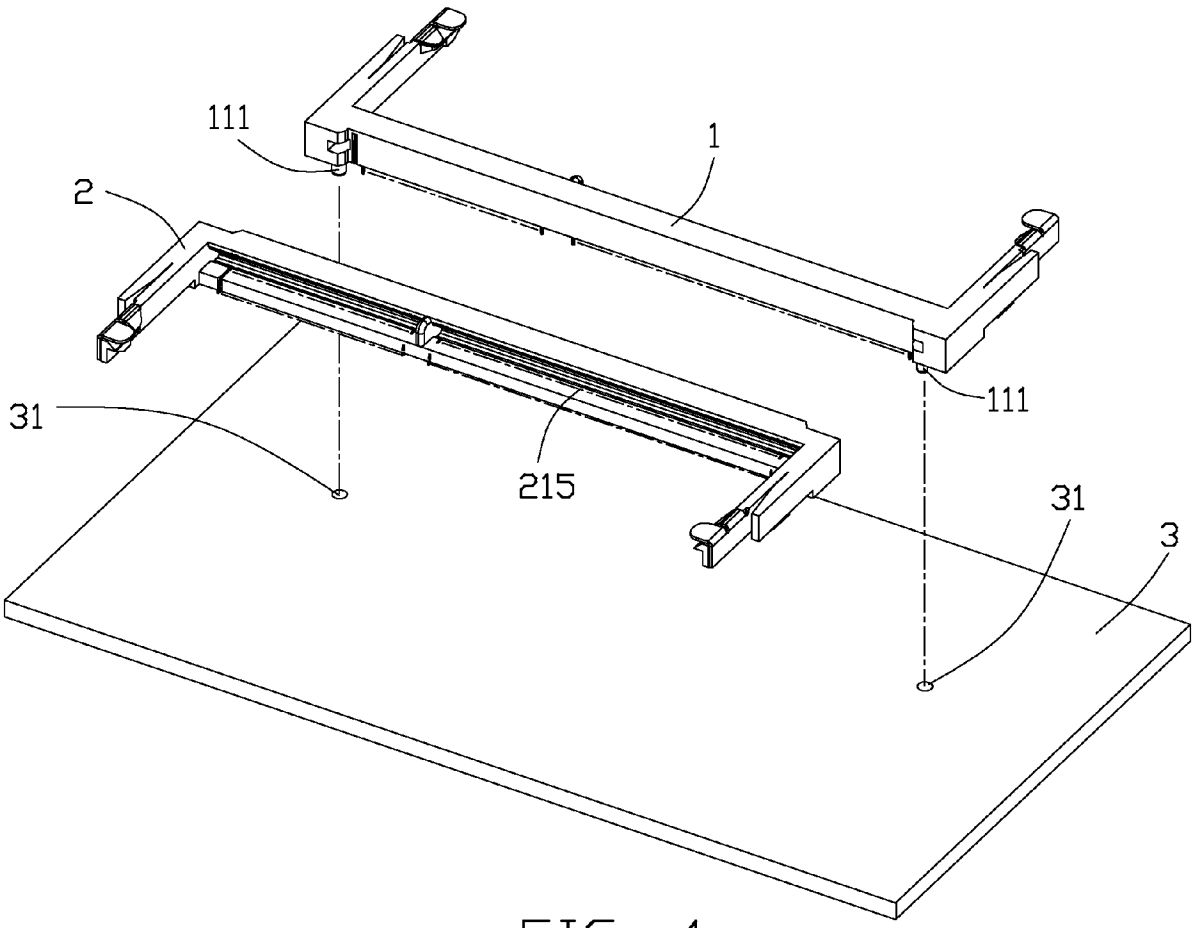
FIG. 4 is a perspective view of the card edge connector assembly is positioned on a circuit board.

As shown in FIG. 4, the mother board 3 defines a pair of mounting holes 31 thereon. Firstly, the position posts 111 of the first card edge connector 1 aligned with the mounting holes 31 are mounted to the mother board 3, the first card edge connector 1 is pre-determined due to the relationship between the position posts and the mounting holes 31. Secondly, the second card edge connector 2 is close to the first card edge connector 1 by the second connector being aligned with the receiving space 112 until the protruding portions 110 of the first card edge connector 1 are accommodated in the recessed portions 210 of the second card edge connector 2. Thus, the first card edge connector 1 and the second card edge connector 2 are snapped together, which will shorten distance between the first card edge connector 1 and the second card edge connector 2 so as to reduce the occupied space of the assembly on the mother board. In addition, the protruding portions 110 of the first card edge connector 1 can prevent the second card edge connector 2 from moving in the longitudinal direction so as to achieve a better position effect.

The protruding portions 110 of the first card edge connector 1 and the recessed portions 210 of the second card edge connector 2 provide a guiding and positioning action when the card edge connector assembly is mounted to the mother board. Furthermore, the positioning method of the card edge connector assembly is simple and convenient, and is conducive to simply the process.

Figure 5:
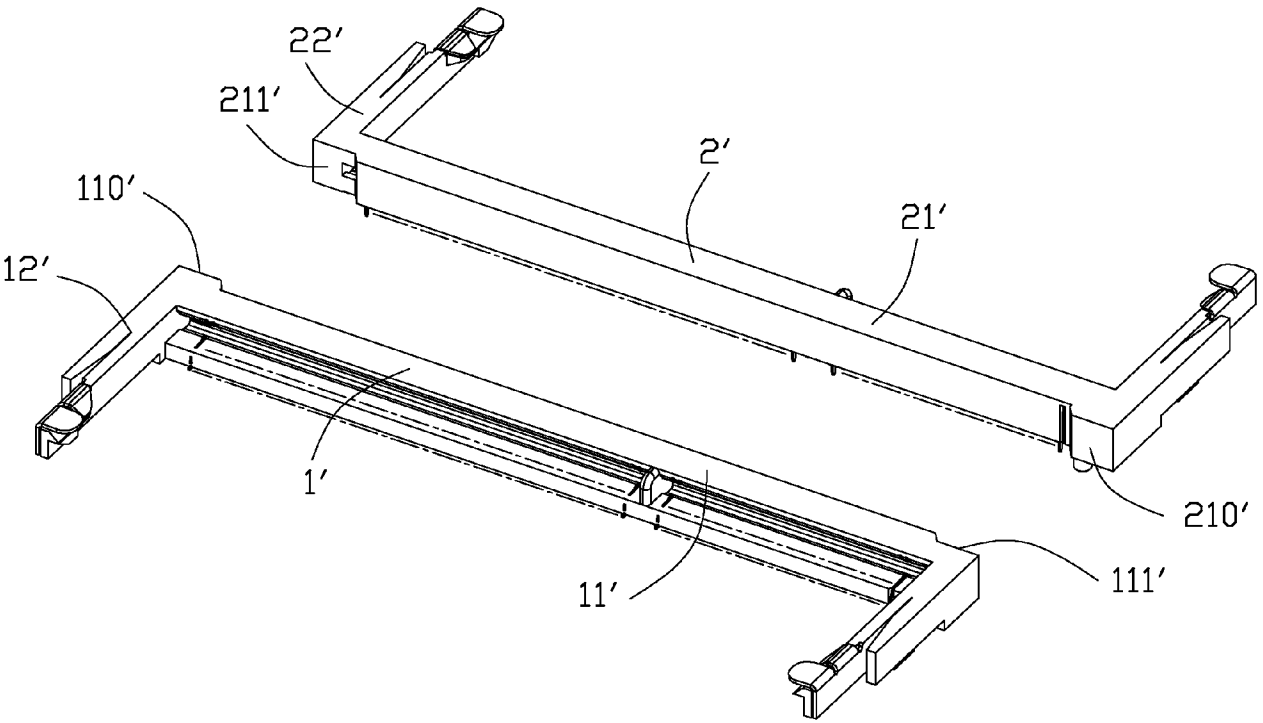
FIG. 5 is an exploded perspective view of a card edge connector assembly in the second embodiment.
Figure 6:
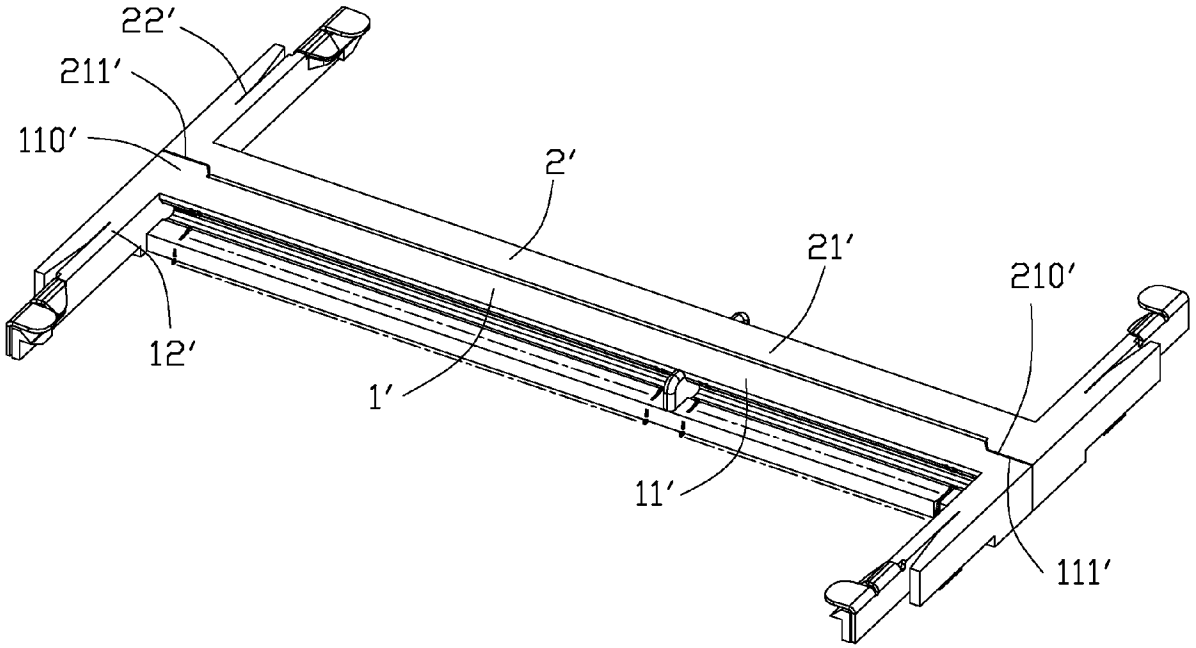
FIG. 6 is an perspective view of the card edge connector assembly shown in FIG. 5.

Referring to FIGS. 5 to 6 illustrating a card edge connector assembly in second embodiment, the connector assembly comprises a first card edge connector 1' and a second card edge connector 2'. The first card edge connector 1' and the second card edge connector 2' each include an insulative housing, a pair of latching arms located on the opposite ends of the insulative housing, respectively. The insulative housing 11' of the first card edge connector 1' defines a protruding portion 110' opposite to the left latching arm 12' and a recessed portion 111' opposite to the right latching arm 12'. The insulative housing 21' of the second card edge connector 2' defines a protruding portion 210' opposite to the left latching arm 22' and a recessed portion 211' opposite to the right latching arm 22'. Means that, the external structure of the first card edge connector 1' and the second card edge connector 2' are substantially same, which will greatly reduce the manufacturing cost of the connector.

when the first card edge connector 1' and the second card edge connector 2' are set in a head to head pattern, the left and right positions of the second card edge connector 2' will occur reversed, at the same time the protruding portions 210' of the second card edge connector 2' is accommodated in the recessed portions 111' of the first card edge connector 1' and the recessed portions 211' of the second card edge connector 2' is accommodated in the protruding portions 110' of the first card edge connector 1' so that the first card edge connector 1' and the second card edge connector 2' are clasped together, which will shorten a distance between the first card edge connector 1' and the second card edge connector 2', thus reducing the occupied space of the assembly on the mother board.

When the first card edge connector and the second card edge connector are set in a head-to-head arrangement, mating mounting portions located between the opposite insulative housings can be combined together by clasped, and includes the recessed portion and the protruding portion as well as other types of structures that can achieve the same functionality, which will shorten the distance between the first card edge connector and the second card edge connector. In addition, a fixed member can also be set between the first card edge connector and the second card edge connector so that they can be combined together to form a card edge connector assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector assembly adapted to being mounted on a mother board, comprising:

a first card edge connector comprising a first insulative housing with a first central slot, a pair of first latching arms disposed on opposite ends of the first insulative housing and a plurality of first conductive terminals retained in the first insulative housing;

a second card edge connector including a second insulative housing with a second central slot, a pair of second latching arms located on the opposite ends of the second insulative housing and a plurality of second conductive terminals retained in the second insulative housing;

the first and second conductive terminals defining pin-shaped solder portions respectively, wherein a rear wall of the first and second insulative housings respectively define protruding portions extended outwardly from the rear wall and recessed portions mutually engaged with each other when the first and second insulative housings are disposed in a head to head arrangement and the first and second latching arms extend far away from each other;

wherein the first insulative housing defines a first key and the second insulative housing defines a second key, the first and second keys are aligned with each other, wherein the first conductive terminals are divided into upper and lower rows and accommodated in the first insulative housing, and the second conductive terminals are also divided into upper and lower rows and accommodated in the second insulative housing, corresponding upper and lower rows of terminals are offset from each other, wherein a fixed member is located between the first card edge connector and the second card edge connector and make them bounded to each other; and wherein the first and second insulative housing are same in external structures.

2. The card edge connector assembly as described in claim 1, wherein the first insulative housing defines a pair of protruding portions opposite to the first latching arms, and the second insulative housing defines a pair of recessed portions opposite to the second latching arms to receive the protruding portions.

3. The card edge connector assembly as described in claim 1, wherein the first insulative housing defines a protruding portion and a recessed portion at opposite ends thereof respectively; the second insulative housing defines a protruding portion and a recessed portion to receive corresponding recessed portion and protruding portion of the first card edge connector.

4. A card edge connector comprising:

an insulative housing defining a pair of latching arms disposed on opposite ends of the housing, and a card-receiving slot extending in a longitudinal direction and opening forward through a front side thereof;

a first row and a second row of terminals loaded in the insulative housing, the terminals comprising contacting portion exposing to the card-receiving slot and soldering portion extending out of the insulative housing; wherein the insulative housing defines at least one recessed portion having an oblique face at rear wall of a rear side opposite to the front side thereof, the at least one recessed portion extend forward beyond the soldering portion;

wherein the insulative housing defines said at least one recessed portion at one end of the row of the terminals and a protruding portion extended from the rear wall of the housing and having an oblique face at the other end of the row of the terminals; and wherein the insulative housing defines a positioning post extending from the protruding portion.

5. An electrical connector assembly comprising:

a first connector including a first insulative housing defining along a longitudinal direction a first longitudinal slot with therein a first key offset toward one end of the first longitudinal slot relative to the other end of the first longitudinal slot;

a pair of first latch arms located at two opposite ends of the first housing, each of said first latch arms extending along a front-to-back direction perpendicular to said longitudinal direction, the pair of first latch arms cooperating with the first longitudinal slot for defining a first module receiving area;

a plurality of first contacts disposed in the first housing and exposed into the first longitudinal slot;

a second connector essentially being a mirror image of the first connector including a second insulative housing defining along said longitudinal direction a second longitudinal slot with therein a second key offset toward one end of the second longitudinal slot relative to the other end of the second longitudinal slot;

a pair of second latch arms located at two opposite ends of the second housing, each of said second latch arms extending along the front-to-back direction, the pair of second latch arms cooperating with the second longitudinal slot for defining a second module receiving area;

a plurality of second contacts disposed in the second housing and exposed into the second longitudinal slot; and said first key being aligned with the second key in the front-to-back direction, said pair of first latch arms being aligned with the pair of second latch arms in the front-to-back direction;

wherein along the front-to-back direction, a back side of the first housing and the back side of the second housing intimately confront each other with a boundary line therebetween, and a pair of positioning posts are essentially aligned with said boundary line in the longitudinal direction;

wherein a back side of each of the pair of first latch arms defines an inwardly recess while that of each of the pair of second latch arms defines an outwardly protrusion extended from a rear wall of the second housing to be snugly received in the corresponding recess; and wherein the recess defines a first oblique face linked to a back side of the first housing, and the protrusion defines a second oblique face linked to a back side of the second housing and confronting the first oblique face in the longitudinal direction.

6. The electrical connector assembly as claimed in claim 5, wherein said pair of positioning posts are essentially aligned with the pair of first latch arms and the pair of second latch arms in the front-to-back direction.

7. The electrical connector assembly as claimed in claim 5, wherein both tails of the first contacts and those of the second contacts are vertical.

8. The electrical connector assembly as claimed in claim 5, wherein confrontation between said first oblique face and said second oblique face restrains relative movement between the first connector and the second connector in the longitudinal direction while not precluding relative movement of leaving away from each other in the front-to-back direction.

* * * * *